US005658623A

United States Patent [19]

Batawi et al.

[11] Patent Number: 5,658,623

[45] Date of Patent: Aug. 19, 1997

[54] PARTING COMPOUND FOR THE HOT FORMING OF ENCASED METAL PARTS AND A PROCESS FOR MANUFACTURING THE PARTING COMPOUND

[75] Inventors: Emad Batawi, Marthalen; John Antony Peters, Winterthur, both of Switzerland

[73] Assignee: Sulzer Innotec AG, Winterthur, Switzerland

[21] Appl. No.: 247,808

[22] Filed: May 23, 1994

[30] Foreign Application Priority Data

May 25, 1993 [EP] European Pat. Off. ..... 93810378

[51] Int. Cl.[6] ..... B22F 3/00

[52] U.S. Cl. ..... 428/34.4; 428/548; 29/423; 29/17.5; 29/17.6; 29/17.7; 29/559

[58] Field of Search ..... 428/34.4, 544, 428/548, 213; 29/17.5, 17.4, 17.6, 423, 17.1, 149.5 B, 441, 559

[56] References Cited

U.S. PATENT DOCUMENTS

| | | | |
|---|---|---|---|
| 2,985,945 | 5/1961 | Nordheim | 29/19 |
| 3,658,565 | 4/1972 | McGlynn | 106/286 |
| 4,966,816 | 10/1990 | Wardlaw | 428/552 |
| 5,121,535 | 6/1992 | Wittenauer et al. | 29/423 |
| 5,127,146 | 7/1992 | Wittenauer et al. | 29/423 |
| 5,154,863 | 10/1992 | Miyahara | 264/65 |
| 5,401,677 | 3/1995 | Bailey et al. | 437/200 |

FOREIGN PATENT DOCUMENTS

| | | |
|---|---|---|
| 0 374 094 | 6/1990 | European Pat. Off. . |
| 1 081 404 | 5/1960 | Germany . |
| 693114 | 6/1953 | United Kingdom . |

*Primary Examiner*—Charles Nold

*Attorney, Agent, or Firm*—Townsend and Townsend and Crew LLP

[57] ABSTRACT

A parting compound in the form of a monolithic component (3*a*, 3*b*) is used in accordance with the invention for the hot forming of encased metal parts (2). This component consists of powder particles strengthened by sintering. The parting compound material is brittle at ambient temperature and at the deforming temperature of the metal parts is plastically deformable or free flowing in a highly viscous manner.

8 Claims, 1 Drawing Sheet

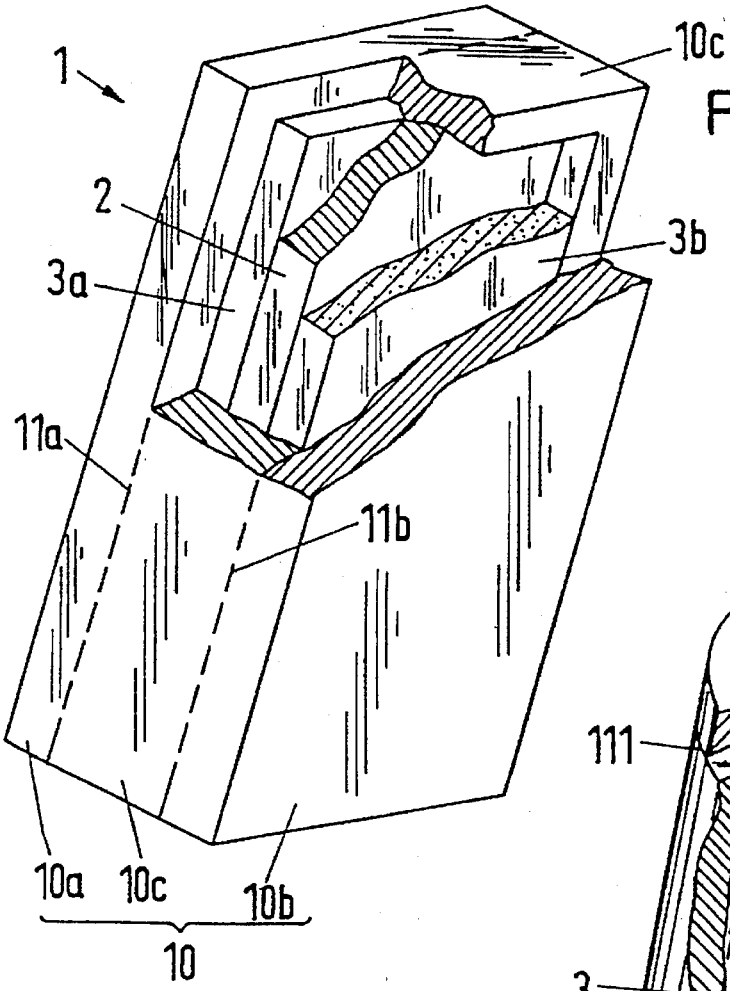
Fig.1
Fig.2
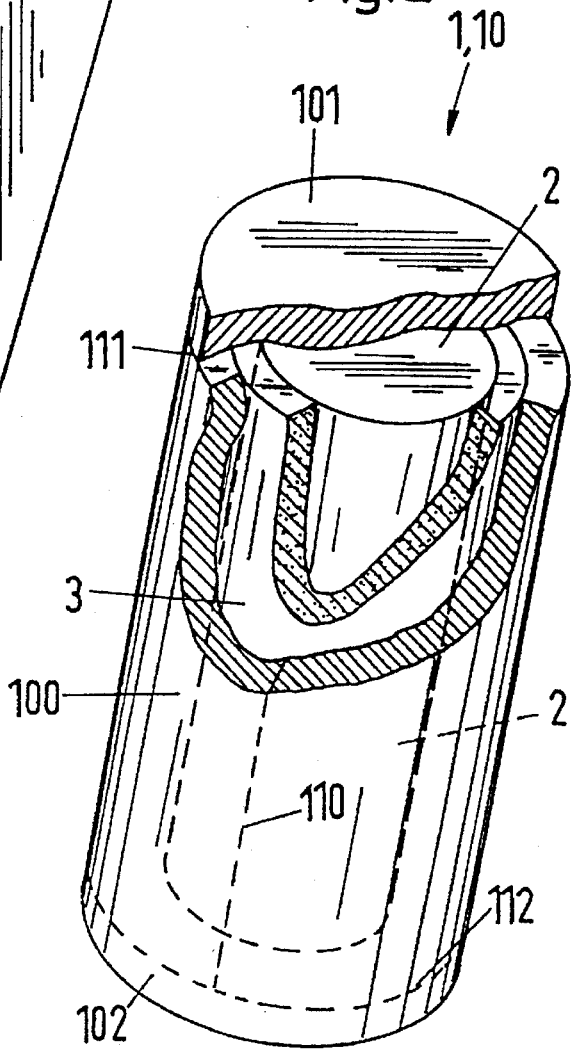
Fig.3
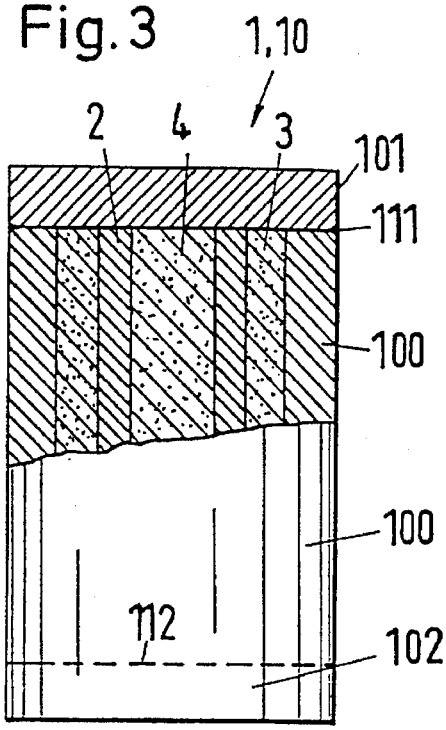

PARTING COMPOUND FOR THE HOT FORMING OF ENCASED METAL PARTS AND A PROCESS FOR MANUFACTURING THE PARTING COMPOUND

BACKGROUND OF THE INVENTION

The invention relates to a parting compound for the hot forming of encased metal parts and also a process for manufacturing the parting compound.

The metal parts to be formed are made in particular from reactive metals, which at elevated temperatures are susceptible to corrosion and which are to be brought into foil form. Hot forming is preferably performed by means of a conventional hot rolling apparatus. The reactive metal together with a case and a parting compound forms a sandwich-like packet. The case, which is welded together from at least two parts (cover plates), seals the reactive metal in a gas-tight manner from the environment. The parting compound, which behaves inertly in comparison with the reactive metal, ensures that a metallurgical connection does not occur between the reactive metal and the case during the hot forming. During hot rolling, the parting compound deforms plastically under the pressure produced or it liquefies like a highly-viscous fluid (i.e., having the capability to fill empty spaces under its own weight) during this a uniform, coherent parting layer is always present between the metals. On the other hand the parting compounds are brittle at ambient temperature, so that the reformed metals can be easily separated from one another.

Such a process for the manufacture of foil is known from EP-A-0374094, which is incorporated herein by reference,: A sheet-like metal piece is surrounded by a case, which is composed of two cover plates and a frame-shaped separator. The reactive metal, from which this metal piece is made, is, for example, a titanium aluminide ($Ti_3Al$ base alloy), which can be reformed at roughly 600° C.–1200° C. Metal halides are proposed as the material for the parting compound; they are inert when compared with titanium base alloys. The parting compound is filled into cavities in the cover plates of the case, by which layers of 0.4 to 2 mm thick are produced. The parting compound material, which exists as a powder, is preferably applied by a thermal spraying process (e.g. atmospheric plasma spraying); in this case, air inclusions are advantageously avoided. Porous layers containing air are produced in other application processes, in which the material is spread or sprayed in the form of an aqueous solution or as a slurry.

Further functions, which are important for the reforming process, can be associated with the parting compound. The parting compound acts as thermal insulation, which advantageously keeps a heat dissipation from the metal piece to be reformed to the rolling device within certain limits. (Cf. U.S. Pat. No. 4,966,816, which is incorporated herein by reference, where a thermally insulating, fibrous intermediate layer is described, which is provided in addition to the parting compound.) The parting compound may also have the advantageous action that the reforming shearing forces act in a gentle manner on the metal piece at high hydrostatic pressure; therefore the risk of cracking is reduced. These actions occur in a particularly distinctive manner in the case of thick parting compound layers. In the known reforming process it is expensive to manufacture a thick parting compound layer because of the special formation of the case.

SUMMARY OF THE INVENTION

The object of the invention is therefore to create a mold in which the parting compound is to be developed, for which the hot forming of an encased metal piece can be performed in an inexpensive manner with a high quality metal piece.

The parting compound is manufactured in the form of separate components, e.g. in the form of plates. The cover plates of the case therefore no longer require a depression to hold parting compounds; they may simply be made from pieces of sheet of constant thickness. Therefore, only a wider case frame has to be provided in order to provide the greater space requirement for the parting compound. The parting compound according to the invention may, for example, be manufactured by means of a slip casting process. In this process, it is simpler to produce thick parting compound layers rather than thin ones.

The hot forming of an encased metal piece may also be performed by means of extrusion by drawing dies, similar to the manufacture of wires. In this case, a tubular component is provided for the parting compound according to the invention.

From the materials already known for the parting agent, calcium fluoride ($CaF_2$, melting point 1418° C.) has proved to be particularly advantageous. Its thermal conductivity is relatively low (9.2 W/m·K at 38° C. and approximately 3 W/m·K at 1000° C.). It also has a relatively high thermal expansion coefficient ($20 \cdot 10^{-6}$ K–1), which is higher than that of the case material and of the metal piece. Thanks to the difference during the thermal expansion, during the heating which is required for the reforming process an elevated pressure builds up in the parting agent as desired.

Powdery $CaF_2$, which contains water of crystallisation and roughly 6000 oxygen ppm by weight, is for example used as the starting material for the parting compound. This powder is reduced to a slurry with distilled water and the slip formed is poured into a mold from which the casting can be removed after drying. The dried casting is sintered. Although the dried casting has an oxygen content which is roughly 50% higher than in the $CaF_2$ powder, a 500 ppm is surprisingly produced for the sintered $CaF_2$. As extensive measurements have shown, the oxygen content passes through a minimum in dependence on the sintering duration at elevated sintering temperatures (above 800° C.), i.e. after roughly one hour. The duration of the sintering process step is advantageously chosen so that the oxygen content of the parting compound is minimal or approximately minimal.

It is important that the oxygen content is as low as possible, as the oxygen can react with the calcium with the setting free of fluorine. In the case of reformed titanium aluminide it has been shown that fluorine can result in corrosion, which signifies an impairment of the surface quality. Furthermore, it is advantageous to remove air bubbles which are contained in the slurry (slip) in an evacuable container by air aspiration.

In order to give the dried casting increased strength properties, the slurry may be mixed with a binding agent; in this case during sintering this binding agent should be able to undergo pyrolysis without any residue or it should be inert with respect to the metal piece to be reformed.

As is known from the manufacture of ceramic structures, the forming may also be performed by means of an extrusion or extrusion moulding process. For this purpose an extrudable powder pulp is required, which can be obtained for example from a slurry provided for the slip casting process by the removal of water.

BRIEF DESCRIPTION OF THE DRAWINGS

The invention is explained in further detail below by means of the drawings.

FIG. 1 shows a first exemplified embodiment for an encased metal piece with the parting compound according to the invention, FIG. 2 shows a second exemplified embodiment and FIG. 3 shows a side view with a partial longitudinal section for a refinement of the second exemplified embodiment.

DESCRIPTION OF THE PREFERRED EMBODIMENTS

FIG. 1 illustrates is represented a sandwich-like packet 1, which is made from a reactive metal in the form of a plate-shaped metal piece 2, a case 10 and a parting compound 3*a*, 3*b* according to the invention. The case 10 consists of two cover plates 10*a* and 10*b* and also a frame-like separator 10*c*; these parts are connected to one another by gas-tight weld seams 11*a* and 11*b*. During the hot forming, the reforming forces are exerted on the cover plates 10*a* and 10*b* by a rolling process. The parting compound 3*a* and 3*b* may be manufactured by means of a slip casting or a extrusion process and subsequent drying and sintering.

In the second exemplified embodiment in FIG. 2 the packet 1 and the metal piece 2 are cylindrical. The parting compound 3 according to the invention is tubular. The case 10 consists of a shell 100 and two closing plates 101 and 102. The shell 100 can be formed from a rectangular sheet metal plate to make a cylinder and be welded along seam 110. The closing plates 101 and 102 are welded to the shell 100 via the seams 111 and 102. The hot forming is performed by means of extrusion by drawing dies, for example. The two processes already mentioned are used again for the manufacture of the parting compound 3. Instead of a circular cross section, a different cross-sectional profile can also be used for the metal piece 2 to be formed. A corresponding shaping operation may then be provided for the parting compound 3 and the case 10.

The metal piece 2 may also be tubular, as shown in FIG. 3. The interior of the metal piece 2 is filled with a core 4. This core 4 may be manufactured from the same material and in the same manner as the parting compound 3. However the core 4 may be manufactured from two parts, i.e. a "core in the core" made from casing material and a parting compound layer surrounding this core.

We claim:

1. A case for the hot forming of a metal part comprising:

a metal cover plate sized to circumscribe the metal part; and a separate, monolithic parting compound having a wall thickness of at least about 0.3 mm and being sized to fit between the metal part and the metal cover plate to facilitate removal of the cover plate from the metal part, the parting compound made from powder particles of a material strengthened by sintering, the material being brittle at ambient temperature and plastically deformable or free-flowing in a viscous manner at a deforming temperature of the metal part, the deforming temperature being about 600° C.–1200° C.

2. A parting compound according to claim 1 wherein the material of the parting compound has a thermal conductivity which is less than approximately 10W/mK.

3. A parting compound according to claim 1 wherein the material of the parting compound comprises calcium fluoride.

4. A parting compound according to claim 3 wherein the parting compound has an oxygen impurity of less than approximately 100 ppm by weight.

5. A parting compound according to claim 1 wherein the monolithic parting compound is a plate having a planar outer surface, the metal cover plate having a planar, inner surface conforming to said planar outer surface.

6. A parting compound according to claim 1 wherein the monolithic parting compound is tubular and defines a circular outer surface, the metal cover plate having a circular inner surface conforming to said circular outer surface.

7. A case for the hot forming of a metal part, the case formed by the process comprising:

forming a metal cover plate size to circumscribe the metal part;

mixing a powder with fluid to form a slurry;

solidifying the slurry in a mold to form a separate, monolithic parting compound having a wall thickness of at least about 0.3 mm sized to fit between the metal part and the metal cover plate; and sintering the parting compound.

8. The case of claim 7 further comprising the step of adding a binding agent into the slurry before the solidify step.

* * * * *